United States Patent [19]

Neppel

[11] 4,305,315

[45] * Dec. 15, 1981

[54] VALVE BOX ADJUSTING TOOL

[76] Inventor: Gerald J. Neppel, 1615 River Rd. NW., East Grand Forks, Minn. 56721

[ * ] Notice: The portion of the term of this patent subsequent to Mar. 3, 1998, has been disclaimed.

[21] Appl. No.: 101,540

[22] Filed: Dec. 10, 1979

Related U.S. Application Data

[63] Continuation-in-part of Ser. No. 39,637, May 16, 1979, Pat. No. 4,253,355.

[51] Int. Cl.[3] ..... B25B 13/16

[52] U.S. Cl. ..... 81/166

[58] Field of Search ..... 81/90 B, 166, 177 A

[56] References Cited

U.S. PATENT DOCUMENTS

| | | | |
|---|---|---|---|
| 2,366 | 11/1841 | Hogle . | |
| 490,519 | 1/1893 | Wayland . | |
| 604,160 | 5/1898 | Reissmann . | |
| 1,357,518 | 11/1920 | Ruff . | |
| 2,549,910 | 4/1951 | Lane | 81/177 A X |
| 2,743,641 | 5/1956 | Stricklett et al. . | |
| 3,094,022 | 6/1963 | Young . | |
| 3,240,086 | 3/1966 | Way | 81/90 B X |
| 3,458,183 | 7/1969 | Rescigno . | |
| 3,910,142 | 10/1975 | Rose | 81/90 B |

OTHER PUBLICATIONS

Joseph G. Pollard Co. Inc., Catalog., p. 99.

*Primary Examiner*—James G. Smith
*Attorney, Agent, or Firm*—Burd, Bartz & Gutenkauf

[57] ABSTRACT

A tool having a gripping mechanism engageable with separate parts of the upper end of a valve box assembly to transfer rotational force to the box assembly to adjust the height thereof. The tool has an upright body connected to a cross handle at its upper end and the gripping mechanism at its lower end. The gripping mechanism has upper and lower members and a plurality of grip members pivotally mounted on the upper and lower members. Each grip member has an adjustable head. Each head has an edge which pivots into driving contact with a separate part of the box assembly when the gripping mechanism is rotated.

19 Claims, 11 Drawing Figures

FIG. 4
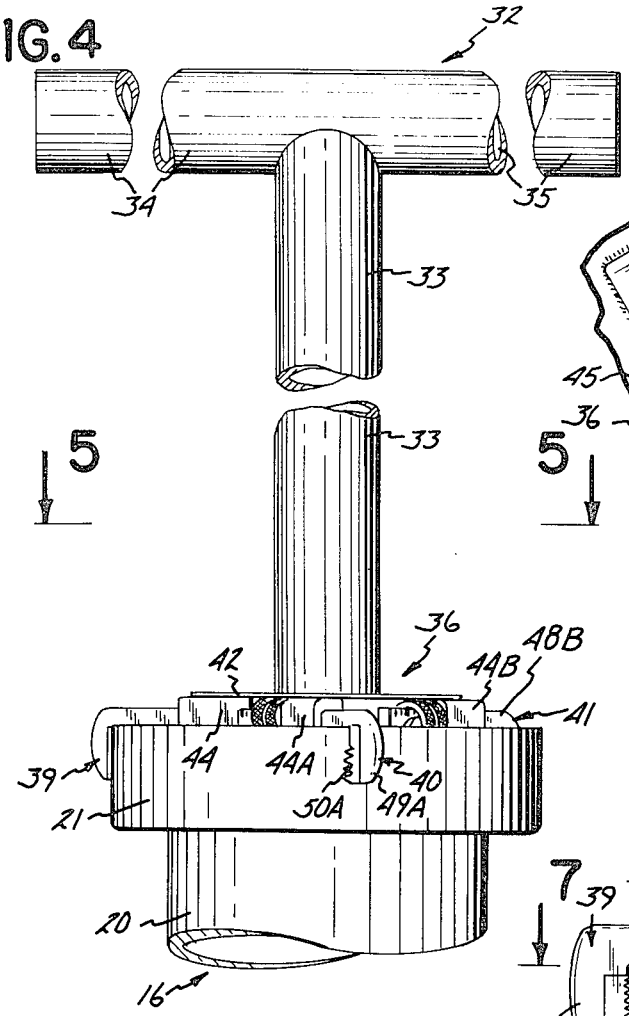
FIG. 7
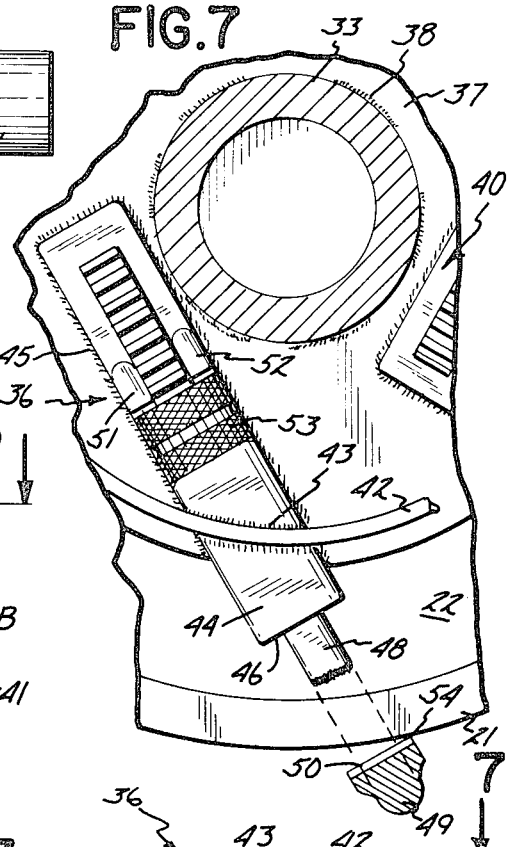
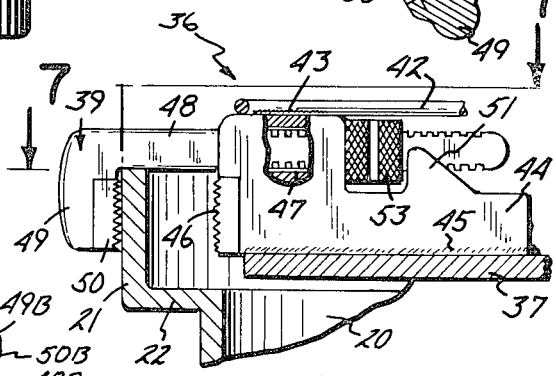
FIG. 6
FIG. 5
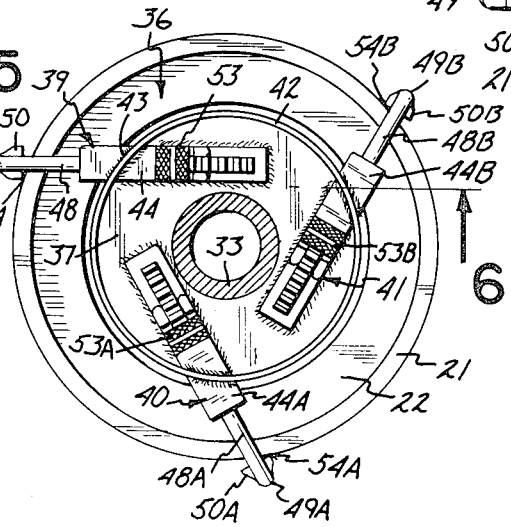

VALVE BOX ADJUSTING TOOL

CROSS REFERENCE TO RELATED APPLICATION

This application is a continuation-in-part of U.S. application Ser. No. 039,637, filed May 16, 1979, now U.S. Pat. No. 4,253,355.

SUMMARY OF INVENTION

The invention is directed to an apparatus for adjusting the length of a two or more piece valve box assembly used to provide access to a valve unit buried in the ground. A conventional valve box assembly is adjustable in length to position the top of the assembly flush with the ground line. The apparatus is a turning tool having a gripping mechanism adapted to grip separate portions of the upper end of the valve box assembly so that rotational force can be applied to the valve box assembly to adjust its height. The gripping mechanism is connected to an upright body carrying a crossbar or handle. Rotational force is applied to the handle to rotate the turning tool. The gripping mechanism includes a plurality of adjustable grip means. In one form of the invention each grip means is located along a cord line with respect to the axis of rotation of the tool. The grip means each have an adjusting sleeve that functions to adjust the position of a head and hold the head in engagement with the side wall of the valve box assembly. In another form of the invention each grip means is pivotally mounted for movement about an upright axis whereby each grip means swings into engagement with upper portions of the valve box assembly. The grip means are adjustable to accommodate different sizes of valve box assemblies and concurrently function to place substantially equal pressure at separate sections of the upper end of the valve box assembly and thereby minimize breakage and damage to the valve box assembly. The turning tool is used by removing only a minimum amount of soil and turf from adjacent the upper end of the valve box assembly. The turning tool is an integral structure with no loose parts that is economical and sturdy in construction.

IN THE DRAWINGS

FIG. 4 is a foreshortened side elevational view of the valve box adjusting apparatus of the invention;

FIG. 5 is a sectional view taken along the line 5—5 of FIG. 4;

FIG. 6 is an enlarged sectional view taken along the line 6—6 of FIG. 5;

FIG. 7 is a sectional view taken along the line 7—7 of FIG. 6;

DESCRIPTION OF PREFERRED EMBODIMENTS

Figure 1:
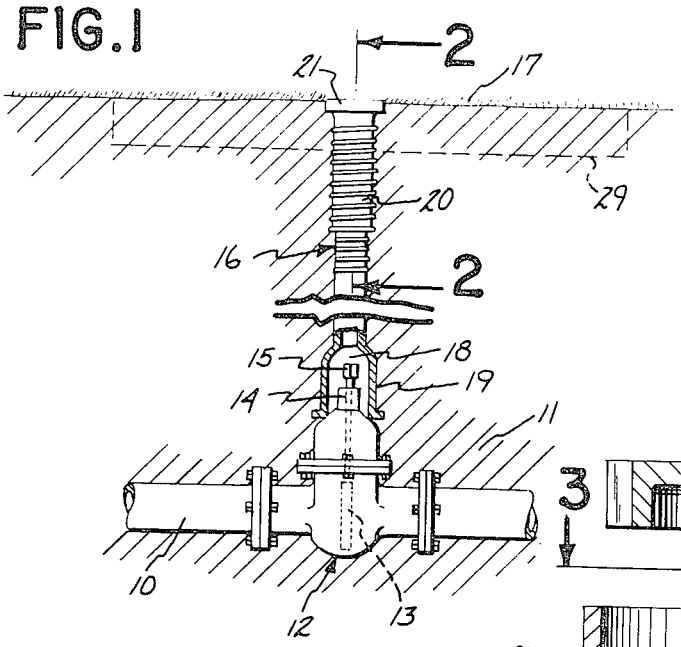
FIG. 1 is a foreshortened side elevational view of a valve unit in a buried water main associated with an adjustable valve box assembly.

Referring to FIG. 1, there is shown a generally horizontal water pipe or main 10 located in the ground 11. It is common practice to locate water pipe under ground below the frost line. Main 10 is connected to a valve unit indicated generally at 12 operable to close the line. Valve unit 12 has a movable valving member or discs 13 operably connected to a control 14. Control 14 includes a threaded member having a square head 15. Head 15 can have other non-circular shapes to accommodate a tool used to rotate control 14 thereby regulating the open and closed positions of valving member 13 to control the flow of water in main 10.

Figure 2:
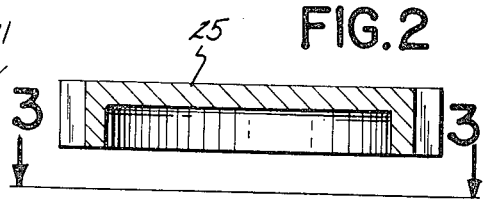
FIG. 2 is an enlarged sectional view taken along the line 2—2 of FIG. 1 with the cap elevated above the top of the valve box assembly.
Figure 2:
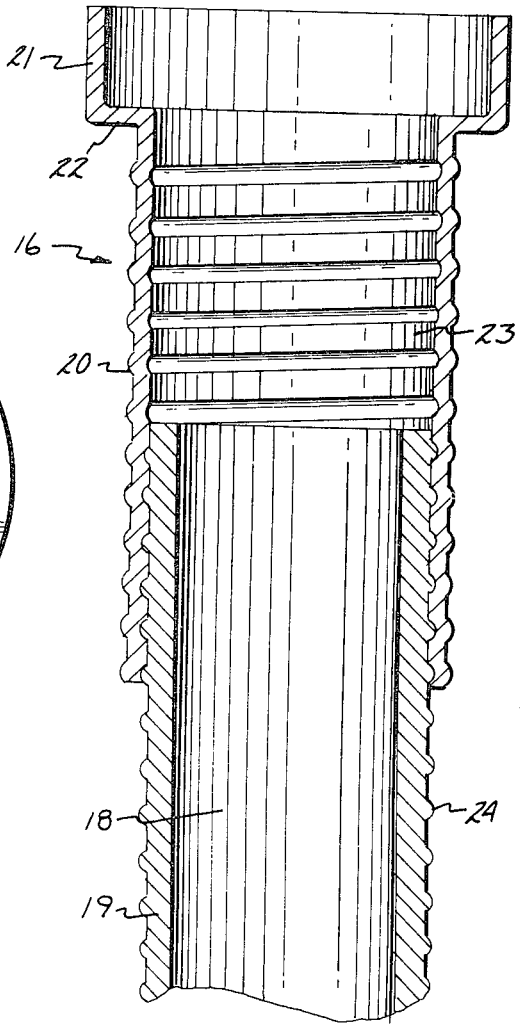

An adjustable valve box assembly indicated generally at 16 is positioned on top of valve unit 12 and extends upwardly to ground surface 17. Valve box assembly 16 is a two part tubular structure having an upright passage 18 leading from control 14 to the ground surface 17. Valve box assembly 16 comprises a lower tubular member 19 having an enlarged bell-shaped lower end that surrounds control 14 and rests on top of the stuffing box of valve unit 12. A second or upper tubular member 20 is threaded on the upper end of the lower member 19. As shown in FIG. 2, upper member 20 has an enlarged upright annular side wall or flange 21 joined to an annular inwardly directed shoulder 22. Threads 23 on member 20 and threads 24 on member 19 cooperate with each other to provide for a selected longitudinal length of the valve box assembly 16. The upper member 20 is rotated relative to lower member 19 to change the overall length of valve box assembly 16. A cap fits into the chamber surrounded by side wall 21 to close the top of passage 18. Valve box assembly 16 is a conventional structure used to provide access to the underground valve unit 12 in water main 10. Valve box assembly 16 is available in a range of lengths. Extensions from 60 to 215 cm or more can be used with members 19 and 20 to increase the length thereof. Members 19 and 20 can be cast iron pipes having an inside diameter of 15 cm. Other materials and structural sizes can be used to make valve box assembly 16.

In use, the adjustable valve box assembly 16 is used to provide for changes in the ground line above water main 10. When water mains are placed under ground, there is ground settlement which results in the upper end of the valve box assembly to project above the ground line. The frost conditions can heave or elevate the ground whereby the upper end of the valve box assembly is located below the ground line. Soil erosion and water run off also removes soil from the ground line adjacent the upper end of valve box assembly 16. It is customary to have the upper end of the valve box assembly 16 flush or even with ground line 17 so that the utility personnel can locate the cap 25 and use a socket-type tool to rotate control 14 thereby controlling the flow of water in main 10.

Figure 3:
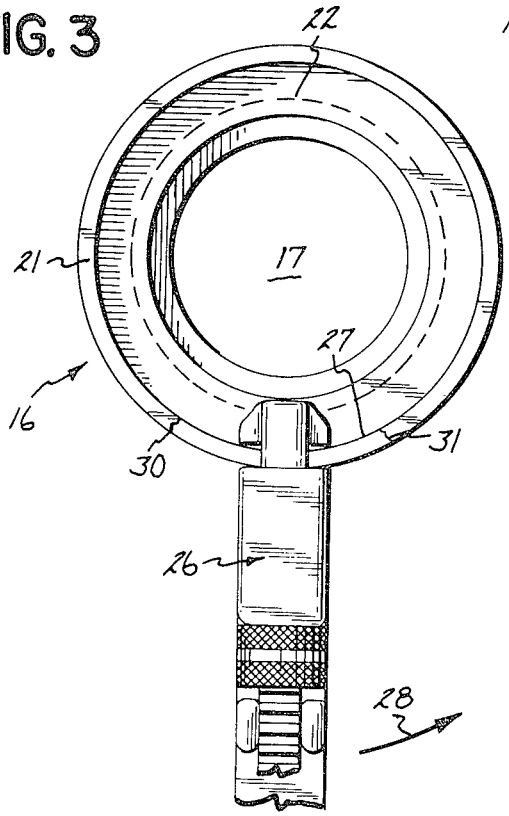
FIG. 3 is an enlarged sectional view taken along the line 3—3 of FIG. 2 in the direction of the arrows.

It has been a prior practice to use a relatively large wrench, such as a pipe wrench 26, as shown in FIG. 3, to rotate the upper member 20 relative to the lower member 19 and thereby regulate the length of valve box assembly 16 and position the upper end thereof relative to ground line 17. Pipe wrench 26 is positioned over a portion of the annular side wall 21 to grip member 20. This requires that a substantial amount of sod and soil be removed from adjacent the upper end of valve box assembly 16. As shown in FIG. 1, a broken line 29 indicates the amount of soil and sod that is normally removed to permit rotation of member 20 with the conventional pipe wrench 26. As shown in FIG. 3, the pipe wrench's jaw and lip are placed adjacent opposite sides of a portion 27 of side wall 22. The pipe wrench 26 extends radially therefrom to provide a torque arm for rotating member 20. When force in the direction of arrow 28 is applied to the pipe wrench 26, large forces are placed on the wall segment 27. These forces are concentrated on a relatively small part or segment 27 of side wall 21 so that when torque is applied to pipe wrench 26 segment 27 breaks out of side wall 21, as indicated by the break lines 30 and 31. When a valve box assembly is broken, it is replaced. This requires extensive excavation, time and expense.

Referring to FIGS. 4 to 6, there is shown the apparatus or turning tool indicated generally at 32 for adjusting the length of valve box assembly 16. This is accomplished with removal of a minimum of soil and sod adjacent flange 21. Apparatus 32 extends vertically above the upper tubular member 20 and grips a plurality of spaced separate portions of side wall 21. Apparatus 32 has an upwardly directed tubular body 33 joined at its upper end to a cross bar or tubular handle 34. Handle 34 has a horizontal passage for accommodating a rod or circular bar used to extend the torque arm of handle 35. The bar can project from either end of handle 35 or both ends of handle 35 so that a plurality of workmen can conveniently rotate body 32 about a generally vertical axis.

A gripping mechanism indicated generally at 36 is attached to the lower end of body 32. Gripping mechanism 36 engages a plurality of separate and circumferentially spaced portions of side wall 21 to equalize the rotational forces that are applied to the side wall 21. Gripping mechanism 36 includes a disc or plate 37 secured by welds 38 to lower end of body 33. A plurality of engaging means indicated generally at 39, 40 and 41 are attached by welds to the top of plate 37. As shown in FIG. 5, gripping means 39, 40 and 41 are located along the sides of an equilateral triangle positioned concentrically about the longitudinal axis of body 33. Each gripping means 39, 40 and 41 extends along a cord line with respect to the circular disc or plate 37. Intersecting cord lines of gripping means 39, 40 and 41 are at an acute angle. A ring 42 is attached by welds to each of the gripping means 39, 40 and 41. Ring 42 and plate 37 hold gripping means 39, 40 and 41 in fixed positions relative to each other. Gripping means 39, 40 and 41 are identical in structure. The following detailed description is directed to gripping means 39. The parts of gripping means 40 and 41 that correspond to the parts of gripping means 39 have the same reference numbers with the suffix A and B, respectively.

Referring to FIG. 6, gripping means 39 has a base or body 44 having a bottom edge located on top of plate 37. Weld 45 secures body 44 to plate 37. Other types of fastening means, as nut and bolt assemblies, can be used to connect body 44 to plate 37. Body 44 has a first jaw 46 located at its outer end facing the inside of side wall 21. Body 44 has a hole or passage 47 accommodating a shank or neck 48. The outer end of neck 48 has downwardly directed head 49. A second or outer jaw 50 is integral with the inside of head 49. Jaw 50 has teeth that face the outside of side wall 21. As shown in FIG. 7, jaw 50 extends at an angle that converges toward and intersects the outside surface of side wall 21. Jaw 50 has a forward edge 54 that bites or digs into side wall 21 when rotational force is applied to cross bar 34. Edge 54 includes the forward ends of corners of the teeth on jaw 50. The teeth corners are relatively sharp to enhance the grip of jaw 50 on side wall 21.

Body 44 has a pair of upwardly directed ears 51 and 52 located on opposite sides of the inner portion of neck 48. A rotatable sleeve 53 threaded on neck 48 is located between ears 51 and 52 and the body 44. Sleeve 53 is rotatable to adjust the position of neck 48 and head 49 relative to body 44. Sleeve 53 is rotated to move head 49 toward side wall 21 and hold edge 54 of the head 49 in engagement with side wall 21.

An example of apparatus or turning tool 32 used to adjust height of a valve box assembly having a top side wall 21 with a 15 cm diameter is as follows. Body 33 is an upright tube having a length of about 1 meter. Cross bar 34 is a tubular member having a length of about ½ meter. The center of the cross bar is secured by welds or the like to the upper end body 33. Plate 37 is a steel disc having a diameter of 12 centimeters secured by a weld to the lower end body 33. The gripping means 39, 40 and 41 are 12 inch or 30 cm pipe wrenches. Each wrench has a handle or base 44 that is secured by welds 45 to the top of plate 37. The first or inner jaws 46, 46A and 46B of each pipe wrench is located about 1 cm outwardly from the outer peripheral edge of plate 37. The outer jaws 50, 50A and 50B each have a plurality of transverse grooves forming teeth that face side wall 21. The teeth terminate in forward edges 54, 54A and 54B that function to dig into side wall 21 when turning tool 32 is rotated in a counterclockwise direction, shown in FIG. 5. The specific example is not intended to limit the size nor structure of the components of turning tool 32. Other structures, materials, and sizes and shape of structure can be used in turning tool 32.

In use, to change the length of valve box assembly 16 a small amount of soil and sod is removed from around the side wall 21. Cap 25 is removed from valve box assembly 16 exposing passage 18. Turning tool 32 is located in an upright position over the top of side wall 21. As shown in FIG. 6, plate 37 fits into the upper end of passage 18 surrounded by side wall 21. The heads 49, 49A and 49B extend over and are located adjacent the outside surface of side wall 21. The workmen move the heads 49, 49A and 49B toward the side wall 21 by rotating the sleeves 53, 53A and 53B. Sleeves 53, 53A and 53B threaded on necks 48, 48A and 48B move the heads inwardly until the side edges 54, 54A and 54B are in engagement with the outside of side wall 21. The sleeves 53, 53A and 53B are adjustable to accommodate the different sized side walls 21 and variations in the structure of side walls 21.

Turning tool 32 is rotated in a counterclockwise direction, as viewed in FIG. 5, to lengthen the valve box assembly 16. The corners 54, 54A and 54B dig into the side wall 21. As shown in FIG. 5, the corners 54, 54A and 54B are circumferentially spaced from each other and engage separate sections of side wall 21. The sections are about 120° apart. Substantially equal pressures or forces are applied to separate sections of side wall 21. This minimizes the breakage or damage to side wall 21 during the turning of the member 20 by turning tool 32. The turning tool 32 is used without disturbing any appreciable amount of soil and turf from adjacent the upper end of valve box assembly. Turning tool 32 is a sturdy and economical structure that has no loose or separable parts. The turning tool 32 can be used with a single workmen to adjust the elevations of valve box assembly 16. This can be done with a minimum of time and labor.

Referring to FIGS. 8 to 11, there is shown a modification of the valve box turning tool or apparatus indicated generally at 100 for adjusting the elevation of an adjustable valve box assembly. Apparatus 100 is operable to grip flange 21 of the upper member of the valve box assembly 16 at several circumferentially spaced locations so that a rotational or turning force can be applied to upper member 20 thereby rotating the member. Rotation of the member 20 will adjust its elevation up or down, depending on the direction of rotation of the member 20, to adjust its location relative to ground level.

Apparatus 100 has an upright tubular body 101 attached at its upper end to a transverse or horizontal tubular cross bar handle 102. Handle 102 has a horizontal passage for accommodating a rod or circular bar (not shown) used to extend the torque arm of handle 102. The bar can project from either end of handle 102 or both ends of handle 102 so that a plurality of workmen can conveniently rotate body 101 about its generally vertical axis in either direction.

A gripping mechanism indicated generally at 103 is attached to the lower end of body 101. Gripping mechanism 103 is operable to engage a plurality of separate and circumferentially spaced portions of side wall 21 of upper member 20 to equalize the rotational forces that are applied to side wall 21. Gripping mechanism 103 includes an upper member or spider 104 having three arms and a lower plate or disc 106. Upper member 104 can be a generally equilateral triangular plate. An upright solid bar 107 extends upwardly from the center of disc 106 through a hole in the center of spider 104. Spider 104 and disc 106 are secured by welds or the like to bar 107. The upper end of bar 107 projects upwardly from the top of spider 104 into the open lower end of tubular body 101. A transverse nut and bolt assembly 108 extends through a hole 109 in bar 107 and a pair of holes 111 and 112 in tubular body 101 to releasably attach tubular body 101 to bar 107. Other types of attaching structures can be used to connect bar 107 to body 101.

A plurality of gripping means indicated generally at 113, 114, and 115 are pivotally mounted on spider 104 and bottom plate 106. Three gripping means are described. The number of gripping means can be two or more structures for engaging separate sections of flange 21. Gripping means 113–115 are identical in structure and circumferentially spaced from each other about 120°. The following detailed description of gripping means 113 is applicable to gripping means 114 and 115. The parts of gripping means 114 and 115 that correspond to the parts of gripping means 113 are identified with the same reference numerals having the suffix A and B, respectively.

Figures 8, 9, 10, 11:
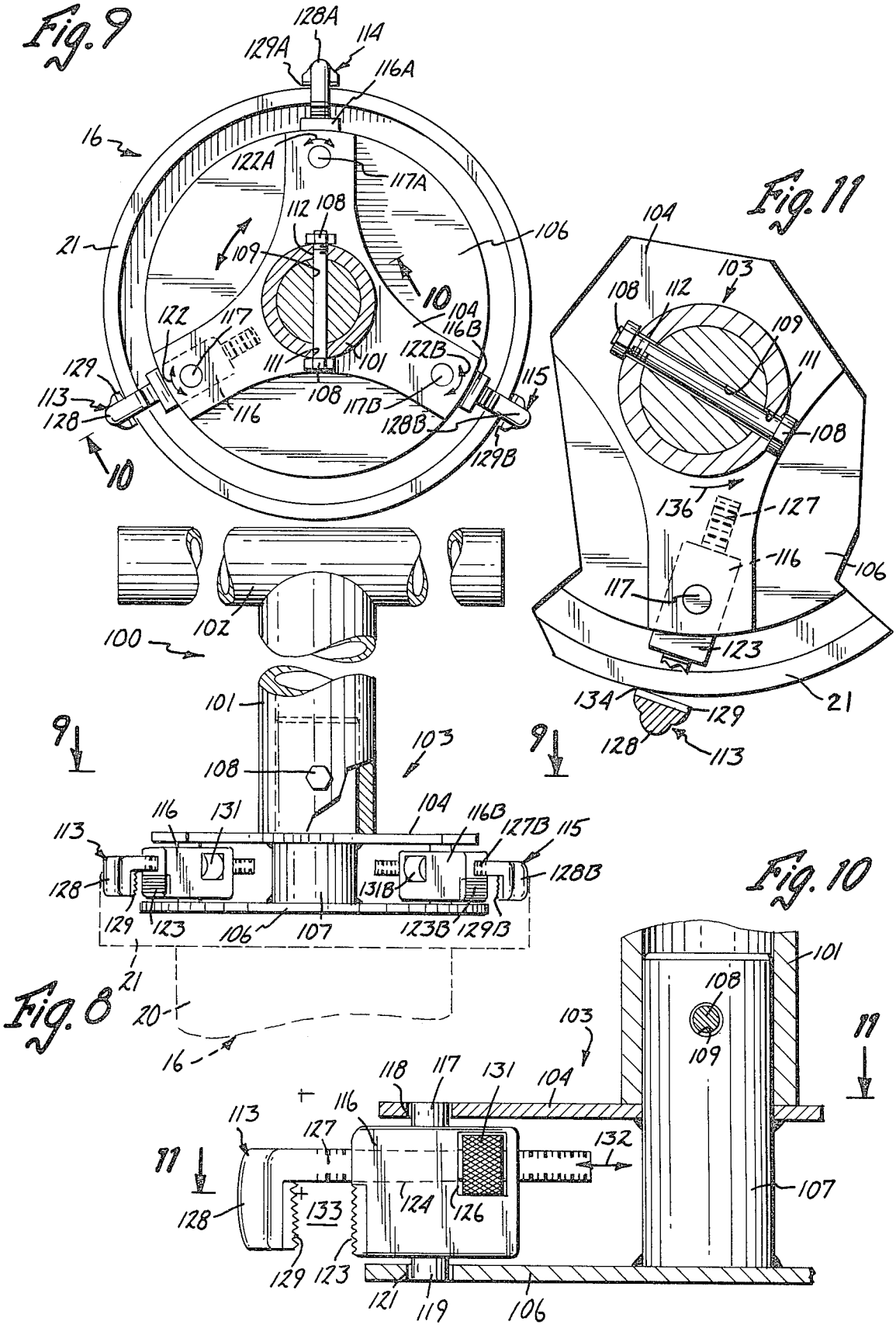
FIG. 8 is a foreshortened side elevational view of a modification of the valve box adjusting apparatus of the invention.
FIG. 9 is a sectional view taken along the line 9—9 of FIG. 8.
FIG. 10 is an enlarged sectional view taken along the line 10—10 of FIG. 9.
FIG. 11 is an enlarged sectional view taken along the line 11—11 of FIG. 10.

Referring to FIGS. 8 and 10, gripping means 113 has a body 116 located between outer portions of spider 104 and plate 106. A first upwardly directed pivot boss 117 secured to the top of body 116 extends through a hole 118 in one arm of spider 104. A second pivot boss 119 secured to a lower portion of body 116 extends through a hole 121 in disc 106. Pivot bosses 117 and 119 are vertically aligned to allow body 116 to pivot or angularly move about an upright axis in opposite directions, as shown by the arrow 122 in FIG. 9.

The outer end of body 116 has a jaw 123 having a plurality of horizontal teeth. A horizontal passage 124 extends through the upper part of the body 116 and through an opening 126. A threaded shank 127 extends through passage 124 and opening 126. The outer end of shank 127 has a downwardly directed head 128. The inside of head 128 has a jaw 129 containing a plurality of horizontal teeth. Jaw 129 is spaced outwardly from and faces jaw 123.

A sleeve or nut 131 located in opening 126 is threaded onto shank 127. Sleeve 131 can be selectively rotated in opposite directions to move shank 127 in opposite longitudinal directions indicated by arrow 132. Sleeve 131 adjusts the position of jaw 129 relative to jaw 123 thereby altering the width or space 133 between the jaws. Sleeve 131 bears against the body 116 to hold jaw 129 in an adjusted position relative to jaw 123. The adjustment of jaw 129 in a generally radial direction allows the gripping mechanism to accommodate variations in the diameters of flange 21, as well as different thickness of flange 21. As shown in FIG. 11, the opposite end edges of jaw 129 have sharp corners 134 that grip or dig into the outer surface of flange 121 when the gripping mechanism 103 is rotated in the direction of the arrow 136.

In use, to change the length of valve box assembly 16 a small amount of soil and sod is moved around from the outside of flange 21. Cap 25 is removed from the top of upper member 16 exposing both the inside and the outside surfaces of flanges 21. Grip mechanism 103 of the turning tool 100 is placed on top of flange 21. The outside heads 128, 128A, and 128B are located over and adjacent the outside of flange 21. The jaws 123, 123A, and 123B are located adjacent the inside surface of flange 21. One or more workmen rotate the tool about the upright axis of tubular body 101. This rotates the gripping mechanism 103 causing the grip means 113, 114, and 115 to pivot about their respective upright pivot bosses 117, 119, 117A, 119A, 117B, and 119B, shown by arrows 122, 122A, and 122B in FIG. 9.

As shown in FIG. 11, body 116 swings in a clockwise direction when tubular body 101 is rotated in a counterclockwise direction, as shown by arrow 136. The corners 134 of the teeth of the jaw 129 dig into the outside of flange 21 so that rotation of the grip mechanism 103 will rotate the flange 21 and thereby change the elevation of upper member 20.

The turning tool can be rotated in an opposite direction. This will pivot the gripping means 113, 114, and 115 in an opposite direction so that the opposite corners of the teeth will dig into and grip the outside of flange 21. The turning tool 100 is useable to rotate the upper member 20 in selective opposite directions. The outer jaws 129, 129A, and 129B are circumferentially spaced from each other and engage separate outside sections of side wall 21. The outer jaws 129, 129A, and 129B are spaced about 120° apart. Substantial equal pressures or forces are applied to the separate sections of the flange 21 to minimize the breakage and damage to the flange 21 during the turning of member 20. The turning tool 100 is used without interfering with an appreciable amount of soil and sod adjacent the upper end of valve box assembly. Turning tool 100 can be used by a single workman to adjust the elevation up and down of valve box assembly 16. This can be accomplished with a minimum of time and effort.

While there has been shown and described preferred embodiments of the turning tool of the invention, it is understood that changes in structures, size and materials of the structure and arrangement of the structure can be made without departing from the invention. The invention is defined in the following claims.

The embodiments of the invention in which an exclusive property or privilege is claimed are defined as follows:

1. An apparatus for rotating a member comprising: body means adapted to be rotated about an axis, and a gripping mechanism attached to the body means adapted to contact a plurality of separate sections of said member to couple the apparatus to the member whereby rotation of the body means rotates the member, said gripping mechanism including first means adapted to be connected to the body means, a plurality of second means for engaging separate sections of the member, each of said second means has head means adapted to engage one section of the member, a body, a first member mounting the head means on the body for movement relative to the body, and a second member cooperating with the first member and body to hold the head means in a selected position, said second member being operable to selectively move the head means toward and away from the one section of the member to adjust the location of the head means relative to the one section of the head member, and third means pivotally connecting the second means to the first means for movement about axes extended generally parallel to the longitudinal axis of rotation of the body means whereby on rotation of the body means the head means of each second means moves into driving contact with said separate sections of said member.

2. The apparatus of claim 1 wherein: the body means is an elongated linear member.

3. The apparatus of claim 1 including: handle means secured to the body means to facilitate rotation of the body means.

4. The apparatus of claim 3 wherein: the handle means is a tubular member having a passage for accommodating means to increase the torque arm of the handle.

5. The apparatus of claim 1 wherein: the first means includes a pair of spaced members, said third means being pivotally connected to the spaced members.

6. The apparatus of claim 1 wherein: each head means has edge means adapted to engage said member upon rotation of the gripping mechanism.

7. An apparatus for rotating a tubular member of a valve box assembly comprising: body means adapted to be rotated about an axis, and a grip mechanism attached to the body means adapted to contact a plurality of separate sections of said tubular member to couple the apparatus to the tubular member whereby rotation of the body means rotates the tubular member, said gripping mechanism including first means adapted to be connected to the body means, a plurality of second means for engaging separate sections of the tubular member, each second means includes a body having a passage, a neck extended through said passage, head means connected to said neck, a sleeve threaded onto the neck engageable with the body to locate the head means relative to the body, said sleeve being rotatable to move the head means relative to the body, and thereby selectively move said head means toward and away from a section of said tubular member to adjust the location of the head means relative to said section of the tubular member, and third means pivotally connecting the body of each second means to the first means for movement about axes extended generally parallel to the longitudinal axis of rotation of the body means, said third means comprising pivot members attached to the body whereby on rotation of the body means, the head means of each second means moves into driving contact with said separate sections of said tubular member.

8. The apparatus of claim 7 wherein: the first means includes a pair of spaced members, said pivot members being pivotally mounted on said spaced member.

9. The apparatus of claim 7 wherein: each head means has edge means adapted to engage said member upon rotation of the body means.

10. The apparatus of claim 9 wherein: said edge means has a plurality of teeth.

11. The apparatus of claim 7 wherein: the second means comprise three grip means pivotally connected to the first means, said three grip means being circumferentially spaced from each other.

12. The apparatus of claim 7 wherein: the pivot members are cylindrical bosses attached to the body.

13. A tool for adjusting a valve box assembly having an upper member with a generally cylindrical top flange, said upper member being rotatable about an axis to adjust the elevation thereof comprising:

body means adapted to be rotated about the axis of the member, and a gripping mechanism attached to the body means adapted to contact a plurality of circumferentially spaced sections of the flange, said gripping mechanism including first means connected to the body means, and a plurality of second means pivotally mounted on the first means for movement into driving engagement with the flange in response to rotation of the body means, each of said second means having head means adapted to engage one section of the flange, a body having a passage, neck means having a threaded portion extended through said passage, said head means being connected to said neck means, sleeve means threaded onto the threaded portion of the neck means, said sleeve means being rotatable to selectively move the head means toward and away from said one section of the flange to adjust the location of the head means relative to the one section of the flange, and third means pivotally connecting the plurality of second means to the first means.

14. The tool of claim 13 wherein: the first means includes a pair of spaced members, said second means being pivotally connected to the spaced members.

15. The tool of claim 13 wherein: each head means has edge means engageable with the flange upon rotation of the gripping mechanism.

16. The tool of claim 13 wherein:

said third means comprising pivot members attached to the body.

17. The tool of claim 16 wherein:

the first means includes a pair of spaced members, said pivot members being located between and pivotally mounted on said spaced members.

18. The tool of claim 13 wherein: the second means comprise three grip means pivotally connected to the first means, said three grip means being circumferentially spaced from each other.

19. The tool of claim 13 wherein:

the third means includes cylindrical bosses on the body pivotally connecting the second means to the first means.

* * * * *